United States Patent [19]

Creskoff

[11] 4,167,549

[45] Sep. 11, 1979

[54] PARTING AGENT FOR MOLDS USED IN FORMING CONCRETE AND METHOD OF USE

[76] Inventor: Jacob J. Creskoff, 200 N. Wynnewood Ave., Wynnewood, Pa. 19096

[21] Appl. No.: 450,119

[22] Filed: Mar. 11, 1974

[51] Int. Cl.[2] ..... B28B 1/50

[52] U.S. Cl. ..... 264/42; 106/38.25; 264/338

[58] Field of Search ..... 264/42, 338; 106/315, 106/87, 38.25

[56] References Cited

U.S. PATENT DOCUMENTS

| | | | |
|---|---|---|---|
| 1,468,343 | 9/1923 | Delaney | 264/42 |
| 1,568,070 | 1/1926 | Jennens | 264/42 |
| 1,637,321 | 7/1927 | Johnson | 264/338 |
| 1,893,607 | 1/1933 | Zottoli | 264/42 |
| 2,114,393 | 4/1938 | Lane . | |
| 3,188,221 | 6/1965 | Matsuda | 106/315 X |

OTHER PUBLICATIONS

The Chemistry of Cement & Concrete, F. M. Lea and C. H. Desch, 2nd ed., Edward Arnold Ltd., London, p. 16, 1956.

Chemical Trade Names and Commercial Synonyms, William Haynes, D. Van Nostrand Co. Inc., N.Y., 1952, p. 265.

*Primary Examiner*—Thomas P. Pavelko

*Attorney, Agent, or Firm*—Caesar, Rivise, Bernstein & Cohen, Ltd.

[57] ABSTRACT

A parting agent for molds used in forming concrete and method of use comprising an effective amount of an acid, an agent which reacts with free alkali in the cement of the concrete mix to form a multitude of tiny bubbles and a vehicle therefor. The preferred embodiment of the invention includes a weak acid, such as tannic acid, form oil as the vehicle and Vinsol-Resin as the bubble forming agent. The term "Vinsol" will be used herein as a short version for Vinsol-Resin.

The method of use comprises applying a coating of the parting agent to the inner surface of a mold and then delivering a sufficient quantity of concrete mix into the mold, completing the formation (curing) of the concrete in the mold, and then removing the cured concrete (casting). The weak acid in the parting agent neutralizes the free alkali in the cement component of the concrete to prevent the formation of a bond between the concrete casting and the mold surface. The "Vinsol" in the parting agent creates air bubbles at the contacting surfaces of the mold and the concrete casting. The bubbles at said contacting surfaces reduce the frictional resistance between the mold and the casting when the latter is being lifted from the mold.

6 Claims, No Drawings

PARTING AGENT FOR MOLDS USED IN FORMING CONCRETE AND METHOD OF USE

This invention relates to a parting agent for a mold used in forming concrete and a method of use.

The use of molds to form various shapes of concrete has become widespread in modern technology. One problem frequently encountered in the molding or casting of concrete is the separation of the concrete casting from the mold.

These are known in the general molding art a large variety of parting agents, such as those used in plastic molding or metal casting. However, such agents have not proved to be satisfactory in the case of concrete molding or casting.

As the shape of the casting becomes more complicated or intricate, the more difficult its removal from the mold becomes. For this reason, it has not been possible to cast and successfully remove certain concrete shapes because it has been virtually impossible to design a mold from which such shapes could be released.

This is primarily because the cement component of the concrete mix undergoes a type of reaction or complexing which results in a bond between the cured concrete and the mold surfaces which greatly increases the problem of casting removal from the mold.

It is therefore a principal object of the present invention to provide a parting agent which will prevent or defeat any tendency on the part of the cement in a concrete mix so to react as to cause bonding of a casting with the mold surface.

Yet another object of the invention is to provide a parting agent of relatively low cost which will facilitate the removal of a concrete casting from a mold.

Still another object of the present invention is to provide a parting agent that is relatively low in cost and yet highly effective in facilitating the removal of a concrete casting from a mold.

Still another object of the present invention is to provide a method of use of a parting agent whereby concrete castings can be easily removed from a mold even where such castings are of complicated shape.

Still another obejct of the present invention is to provide a parting agent and a method of use which are relatively inexpensive and yet highly effective.

The foregoing objects as well as other objects of the invention are achieved through the parting agent of the present invention and method of use invention.

While this specification sets forth at least one preferred embodiment, it is to be understood that the invention is broad in scope.

It has been discovered through the present inventions that easy removal of a concrete casting from a mold can be achieved through the application, prior to casting, of a coating to the inner surface of the mold.

This coating contains an acid, preferably a weak acid, as its prime active agent.

The second component of the coating is a vehicle, such as form oil, water or any other inert vehicle, as will be discussed hereinafter.

All embodiments of the invention will require a third component, such as Vinsol-Resin which reacts with the free alkali of the concrete mix to form tiny bubbles which not only further assist in defeating the formation of any bond or complex between the concrete casting and the mold surface but also reduces the friction between the mold surface and the contiguous surface of the casting thereby making it even easier to remove the casting from the mold.

Vinsol-Resin is a well known and recognized water-soluble soap of a resin acid which has been formed by the reaction of natural wood resin neutralized with Na(OH)2.

It is sold by Master Builders whose headquarters are and for many years have been at 2490 Lee Boulevard, Cleveland, Ohio.

This product is specifically mentioned on Page 360 of the work by A. M. Neville entitled "Properties of Concrete" which was published by John Wiley & Sons, Inc. in 1963.

Examples of acids usable in the present invention include weak organic acids, such as acetic, lactic and tannic acid.

Although we do not wish to be limited to any particular theory as to the specific reaction which occurs between the cement of the concrete mix and the acid component of the parting agent (coating) for the mold nevertheless we believe that it is the reaction between the acid of the parting agent and the free alkali in the concrete mix contacting the same which defeats the formation of any bond or complex with respect to the mold surface.

It is therefore contemplated that, in addition to the acids hereinabove specified, many other well known acids will be usable in the present invention.

The criteria for such acids is that they should not undermine the effectiveness of the free alkali of the cement in the concrete mix and that they should not introduce elements which are detrimental to the cured concrete. Among the detrimental elements are sulphates and chlorides.

It is, of course, understood that the acid will undergo certain reactions with the cement of the concrete mix and, as a result of this, it well may be that the acid is not, in fact, reacting with the free alkali of the cement of the concrete mix but rather some acid derivative, such as a salt or ester, is reacting with the free alkali.

The acid is preferably of pharmaceutical grade.

The acid percentage in the parting agent solution may vary from one half of a percent by weight of the solution to five percent of the solution weight depending on the free alkali in the cement of the concrete mix being used in making the casting.

I have found that in the instances where the cement is made from limestone and clay mined in the Allentown, Pa. area the preferred amount of acid is one percent.

Also present in a proportion of one percent by weight of the solution is Vinsol-Resin.

The reamaining ninety-eight percent by weight of the solution is form oil, water or other vehicle.

When form oil is used as a vehicle, five gallons of the parting agent solution weighs approximately forty two pounds and will cover approximately two thousand square feet of mold surface.

Obviously 6.7 ounces (1% by weight) of this will be the acid and another 6.7 ounces (1% by weight) of this will be the Vinsol-Resin. The remainder, about 41 pounds, (about 98%) will be the form oil.

In view of the foregoing it can be seen that 6.7 ounces of acid covers two thousand square feet of mold surface or 0.335 ounces of acid is used for each one hundred square feet of mold surface.

The free alkali is present as $Na_2O$ and $K_2O$.

While the present invention has been explained in terms of acid, it will readily occur to those skilled in the art that compounds, such as salts, ester, amines and related compounds, which will hydrolyze to the acid when in aqueous or other solutions, may be utilized.

Therefore, while the term "acid" is used in the claims as a matter of convenience, it is to be understood that this term covers the various compounds as specified hereinabove so long as they are active and so long as the products of the hydrolysis are not detrimental to the cured concrete.

Among the detrimental products are sulphates and chlorides.

The parting agent is applied as a coating to the inner surface of the mold in any suitable manner as, for instance, by spraying or brushing, and then allowed to dry.

This coating should preferably be less than 0.01 inches thick.

After the parting agent has dried the concrete mix is poured into the mold which may be of any suitable material. The preferred mold materials now in use are concrete, steel and fiberglass.

In due course the concrete mix in the mold hardens into a casting, which begins its characteristic shrinkage away from the mold surface. Because of the reaction which had taken place between the coating materials and the cement in the surface of the casting, the casting does not adhere to the mold and may easily be stripped therefrom.

A typical concrete mix, in accordance with standard specifications of the American Concrete Institute for designed strength of three thousand pounds per square inch at twenty eight days has a maximum size gravel of one inch and a water-cement reaction of 0.6 with a three inch slump and an air content entrained by Vinsol-Resin of four percent. For each cubic yard of concrete mix there are 1,174 pounds of sand, 2,072 pounds of gravel, 433 pounds of cement, 260 pounds of water and 164 cc Vinsol-Resin.

It will be understood that many other concrete mix formulations will occur to those skilled in the art, and the formulations set forth hereinabove are exemplary only.

Although we do not wish to be bound to any particular theory as to the reaction which is occuring nevertheless we believe that the Vinsol-Resin is present in the concrete mix as a one percent neutralized NaOH solution of petroleum hydrocarbon insoluble fraction of a coal-tar hydrocarbon extract of pinewood.

We also believe that after the Vinsol-Resin in the concrete mix reacts with the alkali of the cement in the concrete mix there is sufficient alkali remaining in the cement of the concrete mix to react with the Vinsol-Resin of the parting agent.

In doing so the Vinsol-Resin of the parting agent not only neutralizes the free alkali in the cement of the concrete mix in contact with the parting agent but also creates bubbles at the contacting surface between the mold and the concrete mix.

These bubbles serve to reduce the frictional resistance between the cured concrete casting and the mold thereby making it easier to lift the casting from the mold.

Of course this merely enhances the ease with which the casting can be lifted from the mold which results from the action of the acid present in the parting agent with the cement of the concrete mix.

Without further elaboration the foregoing will so fully illustrate my invention that others may, by applying current or future knowledge, readily adapt the same for use under various conditions of service.

What is claimed as the invention is:

1. A method of removing a concrete casting from a mold comprising applying to said mold a coating of a parting agent which is no more than 0.01 inch in thickness, said parting agent including an effective amount of an acid, an effective amount of an ingredient which will react with the cement of the concrete to form a multitude of tiny bubbles on the surface of the concrete and a vehicle therefor, said ingredient which will react with the cement of the concrete comprising a petroleum hydrocarbon insoluble fraction of a coal-tar hydrocarbon extract of pinewood, introducing concrete mix into said mold, curing said concrete mix to form a casting and removing said casting from said mold.

2. The method of claim 1 wherein said acid is tannic acid.

3. The method of claim 1 wherein said acid is acetic acid.

4. The method of claim 1 wherein said acid is lactic acid.

5. The method of claim 1 wherein said vehicle is form oil.

6. The method of claim 1 wherein said vehicle is water.

* * * * *